US009816472B2

(12) United States Patent
Lang

(10) Patent No.: US 9,816,472 B2
(45) Date of Patent: Nov. 14, 2017

(54) FUEL INJECTION SYSTEM HAVING A FUEL-CONVEYING COMPONENT, A FUEL INJECTOR AND A CONNECTING DEVICE

(71) Applicant: Robert Bosch GmbH, Stuttgart (DE)

(72) Inventor: Klaus Lang, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/110,569

(22) PCT Filed: Nov. 21, 2014

(86) PCT No.: PCT/EP2014/075253
§ 371 (c)(1),
(2) Date: Jul. 8, 2016

(87) PCT Pub. No.: WO2015/106862
PCT Pub. Date: Jul. 23, 2015

(65) Prior Publication Data

US 2016/0333836 A1 Nov. 17, 2016

(30) Foreign Application Priority Data

Jan. 15, 2014 (DE) ..... 10 2014 200 581

(51) Int. Cl.
*F02M 55/00* (2006.01)
*F02M 61/14* (2006.01)

(52) U.S. Cl.
CPC ..... *F02M 55/005* (2013.01); *F02M 61/14* (2013.01); *F02M 2200/09* (2013.01);
(Continued)

(58) Field of Classification Search
CPC ..... F02M 55/00; F02M 55/005; F02M 61/14; F02M 2200/09; F02M 2200/8023;
(Continued)

(56) References Cited

U.S. PATENT DOCUMENTS 4,346,846 A 8/1982 Eblen et al.
7,856,962 B2 12/2010 Harvey et al.
(Continued)

FOREIGN PATENT DOCUMENTS

EP 678669 10/1995
WO WO2013160038 10/2013

OTHER PUBLICATIONS

International Search Report dated Feb. 27, 2015, of the corresponding International Application PCT/EP2014/075253, filed on Nov. 21, 2014.

*Primary Examiner* — Hieu T Vo
(74) *Attorney, Agent, or Firm* — Norton Rose Fulbright US LLP; Gerard Messina

(57) ABSTRACT

A connecting device for fuel injection systems is used for joining a fuel injector to a cup and to a fuel-conveying component. In this context, connecting elements are provided, which are insertable into the cup in such a manner, that they are situated at least approximately in one plane, which is oriented perpendicularly to a longitudinal axis of a cup. Connecting elements take the form of pin-shaped connecting elements. In addition, the connecting elements are formed in such a manner, that they are inserted into the cup, inside an outer cross-section of the cup. A securing element is also provided for securing the connecting elements. Furthermore, a fuel injection system having such a connecting device is provided.

10 Claims, 4 Drawing Sheets

(52) U.S. Cl.
CPC ..... *F02M 2200/803* (2013.01); *F02M 2200/8023* (2013.01); *F02M 2200/8038* (2013.01); *F02M 2200/8046* (2013.01); *F02M 2200/8053* (2013.01); *F02M 2200/856* (2013.01); *F02M 2200/9015* (2013.01); *F02M 2200/9038* (2013.01)

(58) Field of Classification Search
CPC ..... F02M 2200/803; F02M 2200/8038; F02M 2200/8046; F02M 2200/8053; F02M 2200/856
See application file for complete search history.

(56) References Cited

U.S. PATENT DOCUMENTS

2008/0283627 A1* 11/2008 Dresig ..... F02M 47/027 239/124
2011/0271934 A1 11/2011 Davis

* cited by examiner

FIG. 1
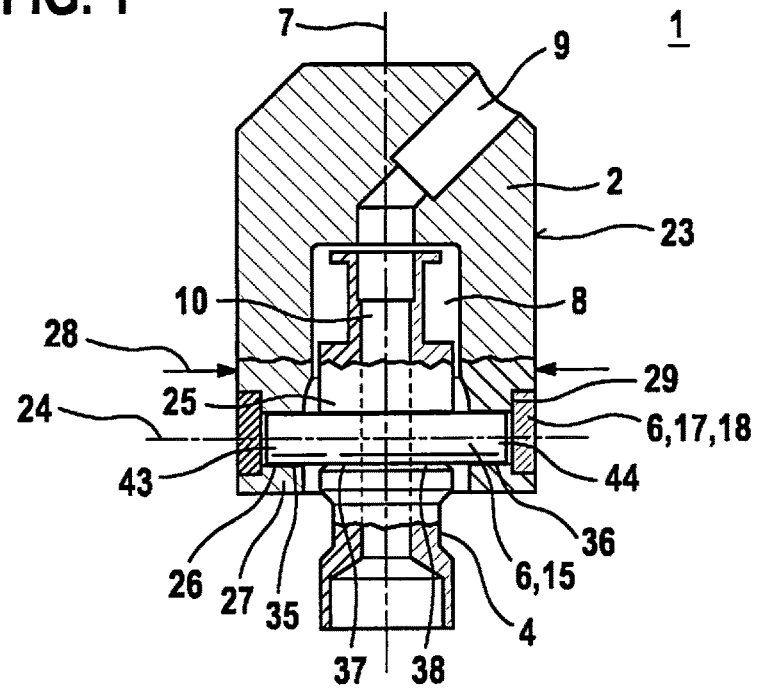
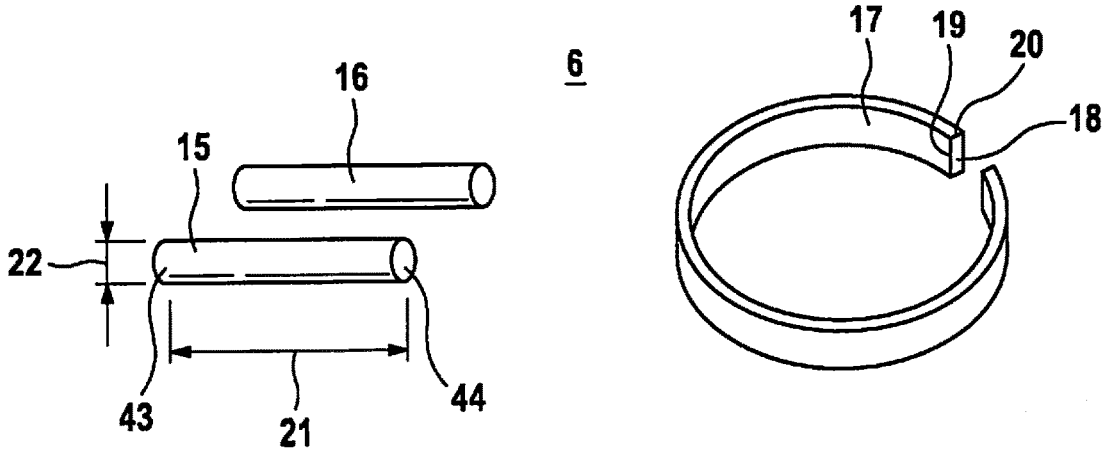
FIG. 2

FIG. 3
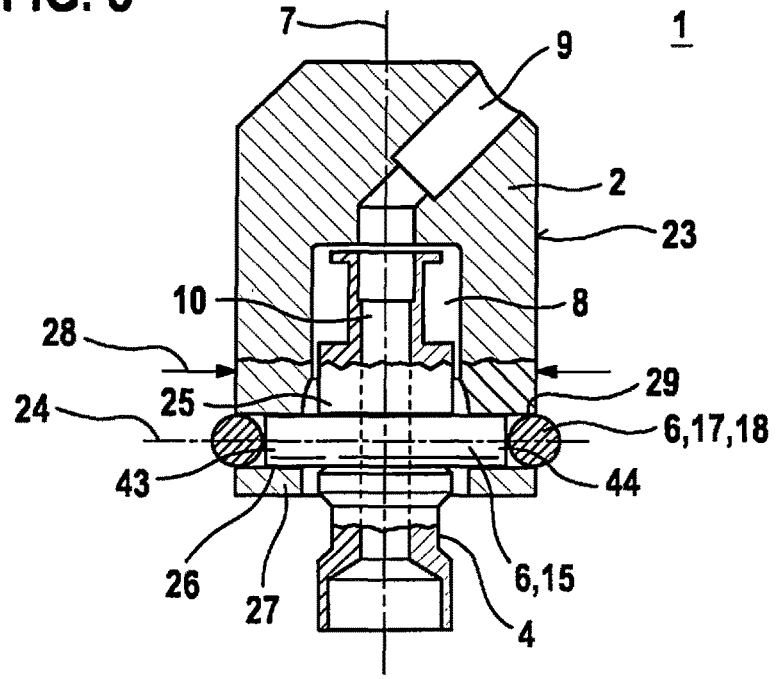
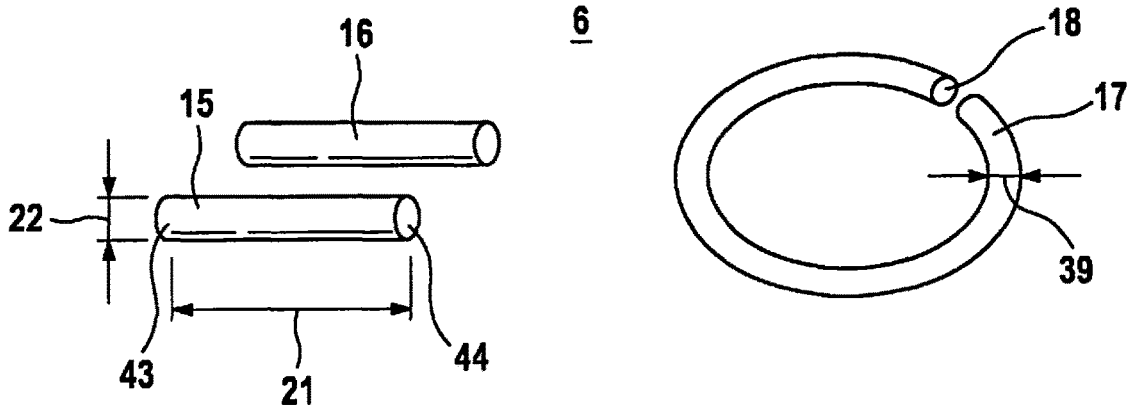
FIG. 4

FIG. 6
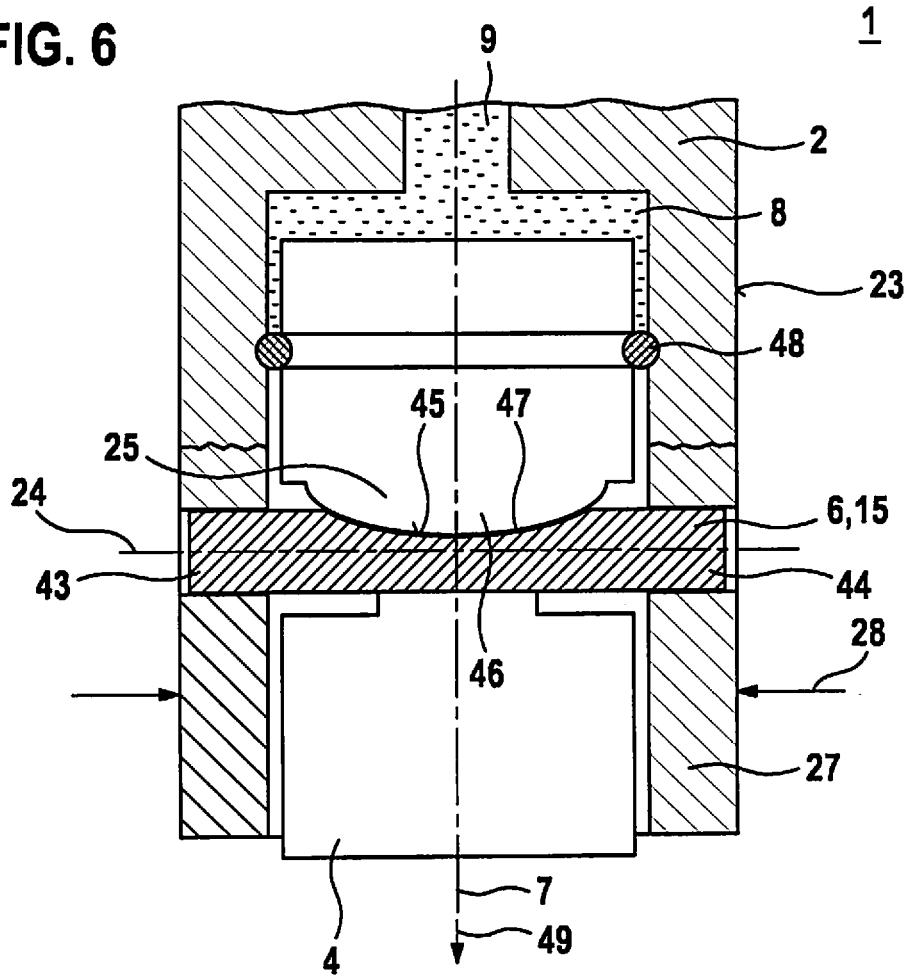
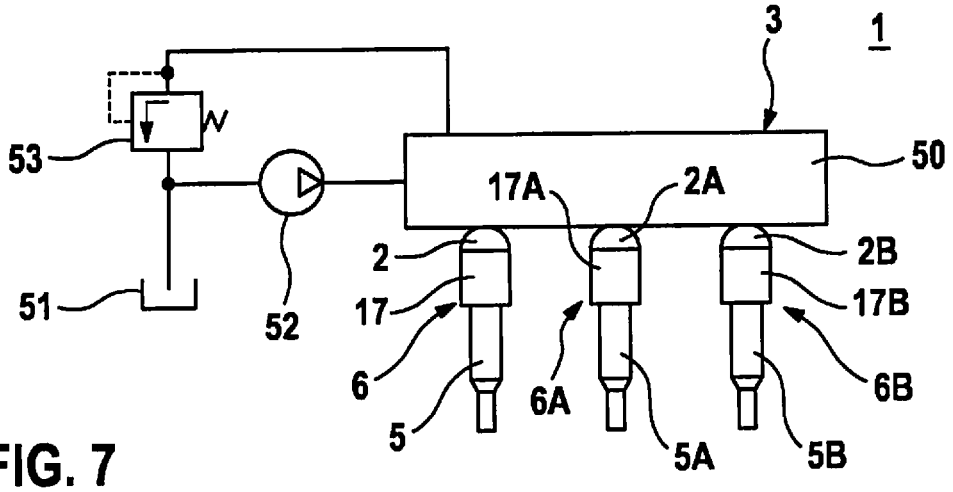
FIG. 7

FUEL INJECTION SYSTEM HAVING A FUEL-CONVEYING COMPONENT, A FUEL INJECTOR AND A CONNECTING DEVICE

FIELD

The present invention relates to a connecting device for fuel injection systems for connecting a fuel injector to a cup of a fuel-conveying component, as well as to a fuel injection system having such a connecting device. In particular, the present invention relates to the area of fuel injection systems for mixture-compressing internal combustion engines having applied spark ignition.

BACKGROUND INFORMATION

A fuel injection system for direct injection in the case of an internal combustion engine is described in U.S. Pat. No. 7,856,962 B2. A cup, to which a fuel injector may be connected via a hollow cylindrical tube and a connecting element, is provided in the conventional fuel injection system. In this connection, the connecting element takes the form of a U-shaped clip, which includes two legs set apart from one another.

The fuel injection system described in U.S. Pat. No. 7,856,962 B2 has the disadvantage that, in particular, in the region of the connection between the fuel injector and the cup, the space needed, and therefore the necessary space requirements in the engine, are large. This stands in the way of increasingly strict requirements called for in practice, regarding the greatest possible utilization of the space available in the engine compartment, in combination with a type of construction that saves as much space as possible.

SUMMARY

The connecting device of the present invention, and the fuel injection system of the present invention, may have the advantage that an improved design and a more compact construction are rendered possible. In particular, a space-saving type of construction is possible, so the increasingly strict requirements for efficient assembly and utilization of the engine compartment may be taken into account.

The fuel injection system is particularly suited for direct gasoline injection. In addition, the connecting device is particularly suited for fuel injection systems that are used for direct gasoline injection. The fuel-conveying component preferably takes the form of a fuel distributor, in particular, a fuel distribution rail. First of all, such a fuel distributor may be used for distributing the fuel to a plurality of fuel injectors, in particular, high-pressure injectors. Secondly, the fuel distributor may be used as a common fuel reservoir for the fuel injectors. The fuel injectors are then preferably connected to the cups of the fuel distributor via connecting devices corresponding to them. In operation, the fuel injectors then inject the fuel necessary for the combustion process into the respective combustion chamber of the internal combustion engine, under high pressure. In this connection, the fuel, compressed and volumetrically controlled by a high-pressure pump, may be conveyed to the fuel distributor via a high-pressure line.

In particular, in the case of electromagnetic high-pressure injectors, which may be used in spark-ignition engines having direct injection, a noticeable and annoying contribution may be made to the overall noise of the engine, which may be described as valve ticking. Such valve ticking is caused by the rapid opening and closing of the fuel injector, in which the valve needle is moved into the corresponding limit stops at a highly dynamic rate. The impact of the valve needles with the limit stops produces short-term, but very high contact forces, which may be transmitted by a housing of the fuel injector to the cylinder head and the fuel-conveying component, when direct contact occurs here. This then results in considerable noise generation at the cylinder head and/or at the fuel-conveying component.

The connecting device may advantageously produce effective decoupling from, on one side, the cylinder head and from, on the other side, the fuel-conveying component, with a compact design and, consequently, a low space requirement. In addition, it is possible to dispense with an additional holding-down clamp that may utilize a spring force, or to design it to provide a lower spring force. Consequently, the fuel injectors may be suspended in an advantageous manner to improve the acoustic characteristics and to reduce the external forces. The mounting of the fuel injector to the cup of the fuel-conveying component with the aid of the connecting device allows the fuel injector to be positioned in such a manner, that the fuel injector is not in direct contact with the cylinder head. In this connection, the required sealing between the fuel injector and the cylinder head may be selected independently of the suspension. For example, a teflon seal may be provided between the fuel injector, in particular, a tip of a valve of the fuel injector, and the cylinder head. In addition, there is a large amount of structural freedom regarding the seal between the fuel injector, in particular, a connecting piece of the fuel injector, and the cup of the fuel-conveying component. Therefore, in this instance as well, the seal shape most favorable for the specific application case may be implemented.

In operation, due to the pressure of the conveyed fuel, a force is applied to the fuel injector in the direction of the cylinder head. In this connection, in order to hold the fuel injector on the cup, a certain retention force is necessary, which is applied to the cup by the support of the fuel injector, in particular, of the connecting piece of the fuel injector; the support being provided by the at least one connecting element of the connecting device. Thus, the necessary retention force may be applied without moving the fuel injector considerably out of the predetermined mounting position. Therefore, it is possible to reliably mount the fuel injector to the cup of the fuel-conveying component with the aid of the connecting device.

Since the connecting element is designed to be insertable into the cup, inside of the outer cross section of the cup, the acoustically advantageous principle of the suspended fuel injectors may also be implemented in very tight spaces. In addition, the geometric design of the connecting element may allow for adaptation to the hydraulic operating pressures. In particular, the connecting element may take the form of a section of wire. Thus, the design also has the advantage that an adjustment to the hydraulic operating pressures may be made by simply varying the inexpensive and accurate wire sections or the like, which may be used to form the connecting elements.

Depending on the embodiment of the connecting device, if desired, it is possible to detachably suspend the fuel injector at the cup of the fuel-conveying component. In this case, none of the connecting parts, that is, none of the connecting elements, extend past the actual fuel reservoir. In this context, the fuel injector is secured by at least one connecting element, which may take the form of a pin; the connecting element being placed at least approximately 90° to the axial direction of the fuel injector and absorbing the hydraulic forces of the internal pressure of the fuel-conveying component, using a form-locked connection. Loss of the connecting element may be prevented by an additional part, namely a securing element, which preferably does not extend past the actual space of the fuel reservoir.

Therefore, it is advantageous to provide a securing element, which is used to secure the at least one connecting element when the at least one connecting element is inserted into the cup, inside the outer cross section of the cup; the securing element being able to be positioned on the cup. In this connection, it is particularly advantageous that the securing element may be positioned on the cup, inside the outer cross section of the cup, in order to secure the at least one connecting element. Consequently, none of the component parts of the connecting device extends beyond the outer cross section of the cup, which reduces the amount of space occupied in the best possible manner.

The securing element may be implemented, for example, by a circumferential retaining ring and/or as a securing plate. Thus, it may be advantageous for the securing element to take the form of an at least partially annular securing element. In this connection, the securing element may take the form of, in particular, a semicircular securing element. However, the securing element may also take the form of a completely closed or substantially closed, annular securing element. As an option, it is also possible to join the ends of such an annular securing element in the assembled state. In addition, it is therefore advantageous for the securing element to have a circular cross section or a rectangular cross section. In the case of an embodiment of the securing element having a rectangular cross section, it is particularly advantageous for the longer side of the rectangular cross section to be oriented along the longitudinal axis of the cup or of the fuel injector. In this manner, a flat construction is possible with regard to attachment to the cup. Through this, it may be particularly ensured that such a strip-shaped securing element does not extend beyond, or only extends slightly beyond the outside surface of the cup. The securing element preferably does not extend beyond the outside surface of the cup, which means that it fits into the cup, inside the outer cross section of the cup.

In addition, or as an alternative, adhesive bonding may be provided in order to secure the at least one connecting element to the cup and/or to the fuel injector when the fuel injection system is assembled. Consequently, in order to secure the connecting element in the assembled state, it is advantageous for the at least one connecting element to be connectible to the cup and/or to the fuel injector at at least one predetermined, cemented joint. In this case, an embodiment of the connecting element and/or the cup and/or the fuel injector is provided, so that such a cemented joint may be produced.

In addition, or as an alternative, the connecting element may also be secured by a plastic extrusion coating. Thus, it is also advantageous that in the assembled state, the at least one connecting element may be secured by an at least partial plastic extrusion coating of the cup.

Securing by crimping is also advantageously possible. In this embodiment, an additional securing element may also be dispensed with when the necessary region(s) are crimped. Consequently, it is advantageous that in the assembled state, the at least one connecting element may be secured by at least one crimp of the cup. In this connection, the cup may be plastically deformed at at least one location or in at least one region. Such plastic deformation may be produced, in particular, at the outside of the cup. The connecting element may then be permanently joined to the cup. In doing this, both a force-locked and form-locked connection may be produced between the cup and the connecting element by plastic deformation.

In addition, a form-locked connection between the connecting element and the fuel injector in the assembled state of the fuel injection system may also be used to secure the connecting element. In such a case, an additional securing element may be omitted, if shifting under operating pressure may be prevented by the form-locked connection. Therefore, it is advantageous for the connecting element to be formed in such a manner, that a form-locked connection between the connecting element and the fuel injector may be produced to secure the connecting element in the assembled state. Similarly, it is advantageous for the fuel injector, in particular, a connecting piece of the fuel injector, to be constructed in such a manner, that the form-locked connection between the connecting element and the fuel injector, in particular, between the connecting element and the connecting piece, may be produced in order to secure the connecting element in the assembled state.

Depending on the embodiment and application case, a combination of the securing measures is also possible. Furthermore, in principle, it is also possible for a plurality of securing measures, which relate to different connecting elements and/or different connecting devices of the fuel injection system, to be used on the fuel injection system. Thus, in particular, reliable and noise-reducing suspension of a fuel injector on the fuel-conveying component may be implemented for small installation spaces.

BRIEF DESCRIPTION OF THE DRAWINGS

Preferred exemplary embodiments of the present invention are explained in greater detail in the following description, with reference to the figures, in which corresponding elements have been provided with matching reference numerals.

FIG. 1 shows a partial, schematic sectional view of a fuel injection system having a connecting device corresponding to a first exemplary embodiment of the present invention.

FIG. 2 shows a schematic perspective view of the connecting device of the first exemplary embodiment shown in FIG. 1.

FIG. 3 shows a partial, schematic sectional view of a fuel injection system having a connecting device corresponding to a second exemplary embodiment of the present invention.

FIG. 4 shows a schematic perspective view of the connecting device of the second exemplary embodiment of the present invention shown in FIG. 3.

FIG. 6 shows a partial, schematic sectional view of a fuel injection system having a connecting device corresponding to a fourth exemplary embodiment of the present invention.

FIG. 7 shows a schematic view of a fuel injection system corresponding to a possible refinement of the present invention.

DETAILED DESCRIPTION OF EXAMPLE EMBODIMENTS

Figure 5:
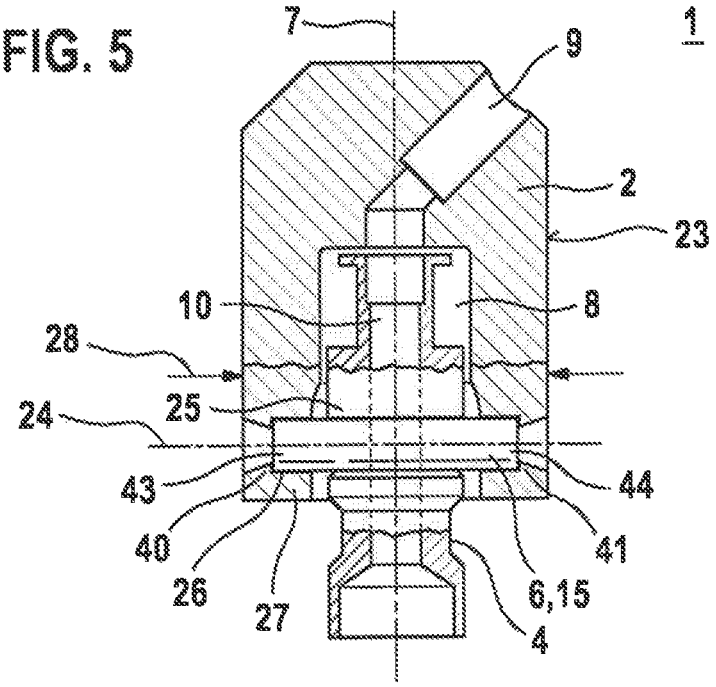
FIG. 5 shows a partial, schematic sectional view of a fuel injection system having a connecting device corresponding to a third exemplary embodiment of the present invention.

FIG. 1 shows, in a partial, schematic sectional view, a fuel injection system 1 having a cup 2, a fuel-conveying component 3 (FIG. 7), a connecting piece 4 of a fuel injector 5 (FIG. 7), and a connecting device 6, according to a first exemplary embodiment of the present invention. In this connection, a longitudinal axis 7 is defined, along which fuel injector 5 or connecting piece 4 of fuel injector 5 is positioned in the assembled state. Longitudinal axis 7 is simultaneously an axis 7 of an interior space 8 of cup 2, into which connecting piece 4 is partially inserted.

Cup 2 includes a fuel intake 9, via which fuel may be conveyed from component 3 into interior space 8 of cup 2. In addition, connecting piece 4 includes a fuel duct 10, through which the fuel is conveyed into an interior chamber of fuel injector 5.

In the following, the form of connecting device 6 of fuel injection system 1 according to the first exemplary embodiment is also described further with reference to FIG. 2.

FIG. 2 shows a schematic perspective view of the connecting device 6 of the first exemplary embodiment represented in FIG. 1, prior to assembly. In this exemplary embodiment, connecting device 6 includes connecting elements 15, 16 and a securing element 17. Connecting elements 15, 16 take the form of pin-shaped connecting elements 15, 16. In this exemplary embodiment, securing element 17 takes the form of a partially annular securing element 17 and, consequently, a sectionally annular securing element 17. In this exemplary embodiment, securing element 17 has a rectangular cross section 18. Rectangular cross section 18 of securing element 17 is formed to have a longer side 19 and a shorter side 20. In this case, longer side 19 is oriented parallelly to longitudinal axis 7. Connecting elements 15, 16 each have a length 21 and a diameter 22. In this connection, length 21 of connecting elements 15, 16 is selected so that in the assembled state, connecting elements 15, 16 do not extend beyond an outside surface 23 of cup 2. In this exemplary embodiment, sufficient space for securing element 17 is also provided, so that in the assembled state, securing element 17 also does not extend beyond outside surface 23 of cup 2. For assembly, connecting elements 15, 16 are preferably positioned parallelly to one another in a plane 24, which is oriented perpendicularly to longitudinal axis 7 of cup 2. When connecting elements 15, 16 are inserted into cup 2, they then interact in a suitable manner with a shoulder 25 of connecting piece 4 of fuel injector 5, so that fuel injector 5 is supported at cup 2. In this exemplary embodiment, cup 2 includes a through-hole 26, which extends through a wall 27 of cup 2 on both sides. Pin-shaped connecting element 15 may be inserted into through-hole 26 in such a manner, that it is insertable into cup 2, inside an outer cross section 28 of cup 2. This means that in the inserted state, connecting element 15 does not extend beyond outside surface 23 of cup 2. A corresponding through-hole is provided for pin-shaped connecting element 16. Connecting element 16 is also formed in such a manner, that it is insertable into cup 2, inside of outer cross section 28 of cup 2.

Thus, the two connecting elements 15, 16 are positioned at least approximately parallelly to one another in plane 24, in order to support fuel injector 5 at shoulder 25 of connecting piece 4. In this manner, fuel injector 5 is joined to cup 2 of fuel-conveying component 3.

Securing element 17 is inserted into a groove 29 of cup 2, which is provided on outside surface 23 of cup 2. In this connection, securing element 17 is situated on cup 2, inside of outer cross section 28 of cup 2. Consequently, in the assembled state, securing element 17 does not extend beyond outside surface 23 of cup 2.

Securing element 17 is used for securing the two connecting elements 15, 16. In this exemplary embodiment, securing element 17 prevents connecting elements 15, 16 from sliding out or being pushed out of their respective through-hole 26. During operation, when the fuel is fed through fuel intake 9 at high pressure, the high hydraulic forces are then absorbed by connecting elements 15, 16 of connecting device 6. The positioning of connecting elements 15, 16 necessary for this function is continually ensured by securing element 17.

In a modified refinement, connecting element 15 may be additionally or alternatively secured by one or more cemented joints 35, 36. Cemented joints 35, 36 may join connecting element 15 to cup 2. In addition, it is possible for corresponding cemented joints 37, 38 to be used for joining connecting element 15 to connecting piece 4 in the region of shoulder 25. Consequently, in order to secure connecting element 15 in the assembled state, connecting element 15 may be joined to cup 2 and/or to fuel injector 5 at at least one predetermined, cemented joint 35 to 38. Similarly, in order to secure connecting element 16 in the assembled state, connecting element 16 may also be joined to cup 2 and/or to fuel injector 5 at at least one predetermined, cemented joint.

FIG. 3 shows a partial, schematic sectional view of a fuel injection system 1 having a connecting device 6 according to a second exemplary embodiment. In addition, FIG. 4 shows a schematic perspective view of the connecting device 6 of the second exemplary embodiment shown in FIG. 3, prior to assembly. In this exemplary embodiment, securing element 17 has a circular cross section 18. In a modified refinement, securing element 17 may also have an elliptical cross section 18. In principle, other cross-sections 18 are also conceivable, in particular, a square cross section 18. Cross section 18 of securing element 17 has a diameter 39. In this connection, diameter 39 may be selected to be the same as or different from diameter 22 of connecting elements 15, 16. In addition, in this exemplary embodiment, securing element 17 takes the form of a partially annular securing element 17. Length 21 of connecting elements 15, 16 is selected to be small enough, that securing element 17 may be situated at least partially within outer cross section 28 of cup 2. In this case, securing element 17 is situated in an annular groove 29, which is formed at outside surface 23 of cup 2.

FIG. 5 shows a partial, schematic sectional view of a fuel injection system 1 having a connecting device 6 according to a third exemplary embodiment. In this exemplary embodiment, connecting device 6 includes connecting elements 15, 16. In this case, in order to simplify the representation, only connecting element 15 is shown. In this exemplary embodiment, connecting element 15 is inserted into through-hole 26 of cup 2. In addition, crimps 40, 41 are provided, by which connecting element 15 is secured. In this connection, crimps 40, 41 are provided on outside surface 23 of cup 2. In this case, depending on the form of crimps 40, 41, a force-locked connection and form-locked connection to connecting element 15 may also be produced.

In this exemplary embodiment, securing element 17 and groove 29 of cup 2 may be omitted. Connecting element 16 may be secured in its through-hole in a corresponding manner, using crimping.

Figure 5A:
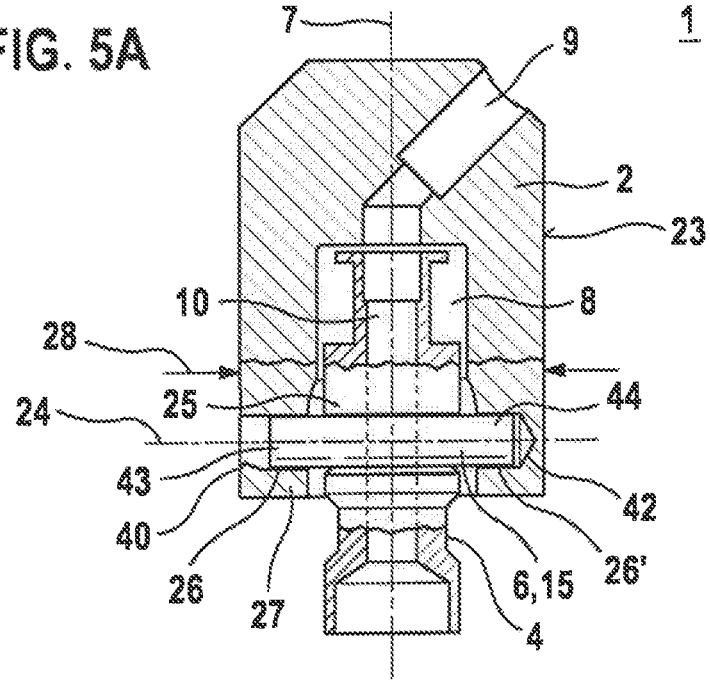
FIG. 5*a* shows a partial, schematic sectional view of a fuel injection system having a connecting device corresponding to a possible modification of the third exemplary embodiment of the present invention.

FIG. 5*a* shows a partial, schematic sectional view of a fuel injection system 1 having a connecting device 6 corresponding to a possible modification of the third exemplary embodiment. In this modified exemplary embodiment, connecting device 6 includes connecting elements 15, 16. In this case, in order to simplify the representation, only connecting element 15 is shown. In this modified exemplary embodiment, bore 26 takes the form of a blind-end bore 26. In this connection, a bottom 42 of blind-end bore 26 is situated in wall 27 of cup 2. Consequently, the two ends 43, 44 of connecting element 15 may each extend into wall 27. This allows connecting element 15 to be secured to cup 2 on both sides, along longitudinal axis 7.

Connecting element 15 is inserted into blind-end bore 26 of cup 2. Furthermore, in the case of this modification, only one (exactly one) crimp 40 is provided, by which connecting element 15 is secured in blind-end bore 26. In this connection, crimp 40 is provided on outside surface 23 of cup 2. In this case, depending on the form of crimp 40, a force-locked connection and form-locked connection to connecting element 15 may also be produced.

Therefore, bore 26 pierces wall 27 only on one side and takes the form of a blind hole 26' on the other side.

Securing element 17 and groove 29 of cup 2 may be omitted. Connecting element 16 may be secured in its blind-end bore in a corresponding manner, using crimping on one side.

In principle, a further modification is also conceivable, in which crimping on both sides is provided for one of the connecting elements 15, 16, as shown in FIG. 5, and crimping on one side is provided for the other, as shown in FIG. 5*a*.

In addition, the embodiment including a blind hole 26' or bore 26 in the form of a blind-end bore 26 may also optionally constitute a possible modification in the case of the other exemplary embodiments.

FIG. 6 shows a partial, schematic sectional view of a fuel injection system 1 having a connecting device 6 according to a fourth exemplary embodiment. In this exemplary embodiment, a recess 45 is provided on connecting element 15. In addition, a convex portion 46 is provided on shoulder 25 of connecting piece 4. In the assembled state, a form-locked connection 47 is formed between convex portion 46 of shoulder 25 of connecting piece 4 of fuel injector 5 and recess 45 of connecting element 15. In operation, fuel is conveyed through fuel intake 9 into interior space 8 of cup 2. In this connection, a seal 48 is provided between connecting piece 4 and cup 2. Connecting piece 4 is acted upon by the fuel pressure (operating pressure) in a direction 49 along longitudinal axis 7, in the direction of a cylinder head of the internal combustion engine. Form-locked connection 47 for the self-fixing of connecting element 5 is ensured by the fuel pressure.

Therefore, depending on the embodiment, the space needed may be limited to outer cross section 28, or may be at least only slightly larger than outer cross section 28 of cup 2. This produces optimized conditions for utilizing the space available in the engine compartment of a motor vehicle or the like.

FIG. 7 shows a schematic view of a fuel injection system 1 corresponding to a possible refinement of the present invention. In this exemplary embodiment, fuel-conveying component 3 includes a base 50 and cups 2, 2A, 2B. Base 50 may take the form of a tubular base 50. However, other designs are conceivable as well. Consequently, component 3 may take the form of a fuel distributor 3, in particular, fuel distribution rail 3. Component 3 may be used for storing fuel and for distributing the stored fuel to a plurality of fuel injectors 5, 5A, 5B of fuel injection system 1. In this connection, the number of fuel injectors 5, 5A, 5B may be selected with regard to the specific application case. As an option, a plurality of components 3, in particular, two bases 50, may also be provided in order to allow distribution of the fuel to cylinder banks of an internal combustion engine situated opposite one another.

Fuel injection system 1 includes a tank 51 and a high-pressure pump 52. In this connection, a primary pump may also be provided, if desired. In addition, a pressure relief valve 53 may be provided, in order to limit the pressure of the fuel conveyed into base 50.

Fuel injectors 5, 5A, 5B are connected to cups 2, 2A, 2B of component 3 by corresponding connecting devices 6, 6A, 6B.

In this exemplary embodiment, connecting device 6 includes a plastic extrusion coating 17, which forms securing element 17. Connecting elements 15, 16, whose design and positioning are described in an appropriate manner with the aid of FIGS. 1 through 6, are secured to cup 2 by plastic extrusion coating 17. In addition, connecting devices 6A, 6B include securing elements 17A, 17B taking the form of plastic extrusion coatings 17A, 17B.

The present invention is not limited to the exemplary embodiments described.

What is claimed is:

1. A connecting device for fuel injection systems for connecting a fuel injector to a cup of a fuel-conveying component, comprising:

at least one connecting element, the connecting element being insertable into the cup in such a manner, that the connecting element is situated at least approximately in a plane, which is oriented perpendicularly to a longitudinal axis of the cup;

wherein the connecting element is in the form of a pin-shaped connecting element, and the connecting element is shaped so that the connecting element is insertable into the cup, inside of an outer cross-section of the cup.

2. The connecting device as recited in claim 1, further comprising:

a securing element to secure the at least one connecting element when the at least one connecting element is inserted into the cup, within an outer cross section of the cup, the securing element configured to be positioned on the cup.

3. The connecting device as recited in claim 2, wherein the securing element is configured to be positioned on the cup inside the outer cross section of the cup, to secure the at least one connecting element.

4. The connecting device as recited in claim 2, wherein the securing element is in the form of an at least partially annular securing element.

5. The connecting device as recited in claim 2, wherein the securing element has one of a circular cross section or a rectangular cross section.

6. The connecting device as recited in claim 1, wherein in an assembled state, the at least one connecting element is joined to at least one of the cup and the fuel injector at at least one predetermined, cemented joint, to secure the connecting element.

7. The connecting device as recited in claim 1, wherein the connecting element is formed in such a manner, that in an assembled state, a form-locked connection between the connecting element and the fuel injector is produced in order to secure the connecting element.

8. The connecting device as recited in claim 1, wherein in an assembled state, the at least one connecting element is secured at the cup by at least one crimp.

9. The connecting device as recited in claim 1, wherein in an assembled state, the at least one connecting element is secured by an at least partial plastic extrusion coating of the cup.

10. A fuel injection system for a mixture-compressing, spark ignition engine, comprising:

a component that conveys at least fuel and includes at least one cup, at least one fuel injector, and at least one connecting device the connecting element being insertable into the cup in such a manner, that the connecting element is situated at least approximately in a plane, which is oriented perpendicularly to a longitudinal axis of the cup, wherein the connecting element is in the form of a pin-shaped connecting element, and the connecting element is shaped so that the connecting element is insertable into the cup, inside of an outer cross-section of the cup;

wherein the fuel injector is joined to the cup of the fuel-conveying component by the connecting device.

* * * * *